US008669506B2

(12) United States Patent
Funis et al.

(10) Patent No.: US 8,669,506 B2
(45) Date of Patent: Mar. 11, 2014

(54) APPARATUS AND METHOD FOR CONTROLLING A VEHICLE, AND VEHICLE CONTROLLED THEREBY

(75) Inventors: Yaakov Funis, Yahud (IL); Amir Shalom, Talme Menashe (IL); Elisha Hoch, Rehovot (IL); Assaf Nachum, Nes Ziona (IL)

(73) Assignee: Israel Aerospace Industries Ltd., Lod (IL)

( * ) Notice: Subject to any disclaimer, the term of this patent is extended or adjusted under 35 U.S.C. 154(b) by 381 days.

(21) Appl. No.: 12/921,603

(22) PCT Filed: Dec. 25, 2008

(86) PCT No.: PCT/IL2008/001675

§ 371 (c)(1),
(2), (4) Date: Apr. 29, 2011

(87) PCT Pub. No.: WO2009/113048

PCT Pub. Date: Sep. 17, 2009

(65) Prior Publication Data

US 2011/0240793 A1 Oct. 6, 2011

(30) Foreign Application Priority Data

Mar. 9, 2008 (IL) ..... 190022

(51) Int. Cl.
*F42B 10/14* (2006.01)

(52) U.S. Cl.
USPC ..... 244/3.29; 244/3.27

(58) Field of Classification Search
USPC ..... 244/3.1, 3.21, 3.23, 3.27, 3.28, 3.29, 244/3.3; 102/348, 388, 490, 400; 114/23
See application file for complete search history.

(56) References Cited

U.S. PATENT DOCUMENTS

| | | | | |
|---|---|---|---|---|
| 3,188,958 | A | 6/1965 | Burke et al. | |
| 4,296,895 | A * | 10/1981 | Pazmany | 244/3.29 |
| 4,844,386 | A * | 7/1989 | Brieseck | 244/3.28 |
| 5,020,436 | A * | 6/1991 | Coburn | 102/377 |
| 6,352,218 | B1 * | 3/2002 | Holmqvist et al. | 244/3.29 |
| 6,360,987 | B1 * | 3/2002 | Sallaee et al. | 244/3.21 |

(Continued)

FOREIGN PATENT DOCUMENTS

| | | | |
|---|---|---|---|
| WO | WO 02/007916 | A1 | 10/2002 |
| WO | WO 2004/104377 | A2 | 12/2004 |

OTHER PUBLICATIONS

International Search Report (PCT/ISA/210) issued on Jun. 16, 2009, by Israel Patent Office as the International Searching Authority for International Application No. PCT/IL2008/001675.

(Continued)

*Primary Examiner* — Tien Dinh
(74) *Attorney, Agent, or Firm* — Buchanan Ingersoll & Rooney PC

(57) ABSTRACT

Apparatus and method are provided for controlling a vehicle in motion through a fluid medium. A manipulable flare assembly is mounted to a load bearing structure, the structure being configured for mounting to the vehicle. An actuating mechanism has a rotational member operably associated with the flare assembly, the actuating mechanism being configured for selectively providing relative rotation between the rotational member and the load bearing structure. The actuating mechanism is configured for manipulating the flare assembly responsive to selective relative rotation between the rotational member and the load bearing structure. A vehicle is also provided incorporating the apparatus.

25 Claims, 4 Drawing Sheets

(56) References Cited

U.S. PATENT DOCUMENTS

| | | | | |
|---|---|---|---|---|
| 6,723,972 | B2 * | 4/2004 | Schroeder et al. | 244/3.3 |
| 6,869,043 | B1 | 3/2005 | Carlyle et al. | |
| 6,871,818 | B1 * | 3/2005 | King et al. | 244/3.28 |
| 6,978,968 | B1 * | 12/2005 | King et al. | 244/3.28 |
| 7,004,424 | B1 * | 2/2006 | Pacchia | 244/3.27 |
| 7,104,497 | B2 * | 9/2006 | Johnsson | 244/3.29 |
| 7,117,682 | B1 * | 10/2006 | Sevi et al. | 60/771 |
| 7,219,579 | B2 * | 5/2007 | Turner | 74/665 N |
| 2002/0079404 | A1 | 6/2002 | Schroeder et al. | |
| 2005/0229806 | A1 * | 10/2005 | Johnsson | 102/490 |
| 2007/0114323 | A1 | 5/2007 | Johnsson | |

OTHER PUBLICATIONS

International Preliminary Report on Patentability (PCT/IPEA/409) issued on Jun. 11, 2010, by Israel Patent Office for International Application No. PCT/IL2008/001675.

* cited by examiner

APPARATUS AND METHOD FOR CONTROLLING A VEHICLE, AND VEHICLE CONTROLLED THEREBY

FIELD OF THE INVENTION

This invention relates to flares, and to vehicles comprising flares. In particular, this invention relates to deployable flares, to mechanisms and methods for deploying flares and to vehicles comprising deployable flares, and to methods and mechanism for controlling a vehicle moving in a fluid medium.

BACKGROUND OF THE INVENTION

It is known to stabilize a projectile in flight, thereby preventing tumbling, by ensuring that the centre of lift (also referred to as the center of pressure) is aft of the center of gravity of the projectile. The larger the static margin, which is the distance between the center of lift and the center of gravity as a proportion of the projectile length, the more stable the projectile is in flight. While a projectile may be stable at launch, events such as jettisoning of part of the projectile or of the body to which the projectile was previously attached during an earlier flight phase can cause the static margin to be altered such that it may no longer be sufficient to ensure stable flight.

It is also known to cause the centre of lift to move upon the occurrence of an event that changes the static margin, such as the aforementioned jettisoning of a body previously attached to the projectile.

For example, U.S. Pat. No. 6,871,818 and U.S. Pat. No. 6,869,043 each discloses a flare disposed toward the rear of the projectile, the flare having petals that deploy from a first, stowed position to a second, deployed position upon the occurrence of the event. In the stowed position, the petals are aligned with the air stream, in order to minimize drag. In the deployed position, the petals project into the air stream in such a way as to move the lift center rearward. A slide ring within the flare has sufficient inertia that it shifts aft in response to an acceleration that occurs when the attached body and the projectile are separated from one another. The slide ring is linked to the petals in such a way that the petals are deployed by the displacement of the slide ring. The slide ring is prevented from moving aft during launch of the projectile by slide supports which separate from the aft body when the separation event occurs. Detents lock the slide ring in its displaced position.

In U.S. Pat. No. 6,723,972, a method and apparatus are disclosed for planar actuation of a flared surface to control a vehicle. According to one aspect, there is disclosed an apparatus for controlling a vehicle capable of moving through a fluid medium. The apparatus includes a flare; a planar yoke operably associated with the flare; a plurality of actuators capable of moving the planar yoke to manipulate the flare through the operable association between the planar yoke and the flare; and a load bearing structure through which the translating means imparts a moment from the flare to the vehicle. According to another aspect, there is disclosed a method for controlling the maneuvering of a vehicle capable of moving through a fluid medium. The method includes moving a planar yoke to deflect at least a portion of a flare.

SUMMARY OF THE INVENTION

According to a first aspect of the invention there is provided an apparatus for controlling a vehicle in motion through a fluid medium, for example in atmospheric flight, comprising:

a manipulable flare assembly mounted to a load bearing structure, said structure being configured for mounting to the vehicle;

an actuating mechanism comprising a rotational member operably associated with the flare assembly, said actuating mechanism being configured for selectively providing relative rotation between said rotational member and said load bearing structure, wherein said actuating mechanism is configured for manipulating said flare assembly responsive to selective relative rotation between said rotational member and said load bearing structure.

The load bearing structure may be configured for being statically mounted to the vehicle, and said rotational member is mounted for rotation to said load bearing structure.

Additionally or alternatively, said flare assembly is manipulable at least from a non-deployed configuration to a deployed configuration responsive to a selective relative rotation between said rotational member and said load bearing structure.

Additionally or alternatively, the vehicle is adapted for motion through air, and said flare assembly comprises at least one aerodynamic load-bearing element hingedly mounted to said load bearing structure, wherein said flare assembly is manipulable to enable the or each said load bearing element to be deflected in at least an outwardly generally radial direction with respect to a longitudinal axis of said apparatus to provide a desired flare angle for said flare assembly, including at least a said flare angle corresponding to said deployed configuration. In some embodiments, the load bearing elements may be circumferentially displaced from one another, at least when deployed, and optionally may be mechanically joined via any suitable arrangement, for example including passive petals, or a foil, fabric, canopy or accordion arrangement between adjacent load bearing elements.

Additionally or alternatively, said flare assembly comprises at least one load-bearing element hingedly mounted to said load bearing structure and configured for generating fluid-dynamic loads when deflected, wherein said flare assembly is manipulable to enable the or each said load bearing element to be deflected in at least an outwardly generally radial direction with respect to a longitudinal axis of said apparatus to provide a desired flare angle for said flare assembly, including at least a said flare angle corresponding to said deployed configuration. Optionally, said flare assembly comprises a plurality of said load bearing elements in the form of active petals and passive petals, each said petal being hingedly mounted at one end thereof to said load bearing structure in circumferential arrangement with respect to said longitudinal axis of said apparatus, wherein said flare assembly is manipulable to enable each said petal to be deflected in at least an outwardly generally radial direction to provide a desired flare angle for said flare assembly, including at least a said flare angle corresponding to said deployed configuration. Further optionally, each said passive petal is intercalated between, and coupled for movement with, one said active petal at each lateral side thereof. Further optionally, each said passive petal comprises a coupling element configured for enabling a said active petal on either lateral side thereof to be slidingly engaged with freedom of movement in a general transverse direction with respect thereto.

Additionally or alternatively, said rotational member is operably associated with the flare assembly via a guide and roller arrangement, comprising at least one set of a roller and a guide.

Additionally or alternatively, said rotational member is operably associated with the flare assembly via a guide and roller arrangement, comprising at least one set of a roller and a guide. Optionally, the or each said set is associated with a respective said active petal, and wherein in operation of said actuation mechanism said roller cooperates with a respective guide in a manner to at least deploy the respective said active petal. Further optionally, for at least one said set, the respective roller is mounted for rotation to the respective said active petal, and wherein the respective guide is comprised in said rotational member. Further optionally, the or each said guide comprises an external surface which cooperates with said roller during operation of said actuation mechanism, said exterior surface having a profile configured for displacing the roller in an outwardly radial direction with respect to said axis with said relative rotation between said rotational member and said load bearing structure.

Additionally or alternatively, said actuation mechanism comprises a motion inducing mechanism configured for selectively providing a drive force for driving said selective relative rotation between said rotational member and said load bearing structure. Optionally, said motion inducing mechanism comprises at least one piston configured for extending in a generally non-radial direction, and coupled to said rotational member and said load bearing structure to provide said relative rotation therebetween during operation of said actuation mechanism. Further optionally, at least one said piston is selectively actuatable by means of a pyrotechnic charge. In particular embodiments, said profile is configured for providing a radial displacement for said flare assembly as a function of said rotation such as to maintain external reaction forces on said flare assembly, generated responsive to said radial displacement, at a magnitude less than said drive force. Optionally, said profile provides a relatively high rate of said radial displacement with respect to an angular displacement associated with said rotation at low values of said radial displacement, progressively changing to a relatively low rate of said radial displacement with respect to said angular displacement at higher values of said radial displacement, and approaching zero change in radial displacement at a maximum value of radial displacement.

According to a second aspect of the invention, a vehicle is provided, configured for moving through a fluid medium and comprising an apparatus according to the first aspect of the invention or any variation thereof. For example, the vehicle may be an air vehicle, for example a projectile, missile or the like, configured for atmospheric flight.

According to a third aspect of the invention, a method is provided for controlling a vehicle in motion through a fluid medium, comprising:

providing a manipulable flare assembly mounted to the vehicle in a load bearing manner with respect thereto;

selectively providing an actuating force for manipulating said flare assembly to thereby control the vehicle, wherein at least a component of said actuating force is directed along a plane substantially normal to a longitudinal axis of the vehicle.

The method may additionally comprise providing an actuating mechanism comprising a rotational member operably associated with the flare assembly, said actuating mechanism being configured for selectively providing relative rotation between said rotational member and said load bearing structure, wherein said actuating mechanism is configured for providing said actuating force for manipulating said flare assembly responsive to selective relative rotation between said rotational member and said load bearing structure.

Additionally or alternatively, a cam arrangement may be provided for transferring said actuating force to said flare assembly for manipulation thereof, wherein said cam arrangement comprises at least one cam, said cam being configured for providing a radial displacement for said flare assembly as a function of said rotation via a cam profile such as to maintain external reaction forces on said flare assembly, generated responsive to said radial displacement, at a magnitude less than said drive force. In particular embodiments, said cam profile provides a relatively high rate of said radial displacement with respect to an angular displacement associated with said rotation at low values of said radial displacement, progressively changing to a relatively low rate of said radial displacement with respect to said angular displacement at higher values of said radial displacement, and approaching zero change in radial displacement at a maximum value of radial displacement.

According to a fourth aspect of the invention, a method is provided for manipulating a flare assembly or the like, comprising selectively providing a drive force coupled to said flare assembly via a cam arrangement having at least one cam, wherein the or each said cam comprises a cam profile configured for providing a radial displacement for said flare assembly with respect to a longitudinal axis thereof responsive to said drive force being applied to said flare assembly via said cam arrangement, such as to maintain external reaction forces on said flare assembly, generated responsive to said radial displacement, at a magnitude less than said drive force.

In specific embodiments, said cam profile provides a relatively high rate of said radial displacement at low values of said radial displacement, progressively changing to a relatively low rate of said radial displacement at higher values of said radial displacement, and approaching zero change in radial displacement at a maximum value of radial displacement.

A feature of at least some embodiments of the invention is that the actuation mechanism for manipulating the flare assembly can be very compact, for example as compared to actuation mechanism that are configured for providing an actuation force generally parallel to the longitudinal axis of the vehicle.

Another feature of at least some embodiments of the invention is that the energy of the actuation mechanism can be used optimally such that sufficient actuation force is provided throughout operation of the actuation mechanism to overcome aerodynamic or other fluid dynamic forces that are generated as a result of operation of the actuation system and deployment of the flare assembly. In at least some embodiments, this may be achieved by providing a suitable cam profile that effectively transfers a generally tangential or circumferential force generated by the actuation system, into a radial force for deploying the flare assembly, wherein at the beginning of the actuation, where the aerodynamic forces (or other fluid dynamic forces, mutatis mutandis) are relatively low, the profile provides for a relatively large radial deflection for a given work output (force*distance) of the actuation system, and as the radial displacement gets larger as the flare assembly is deployed, and the aerodynamic forces (or other fluid dynamic forces, mutatis mutandis) progressively get larger, the profile provides for a diminishing radial displacement for the same work output of the actuation system.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
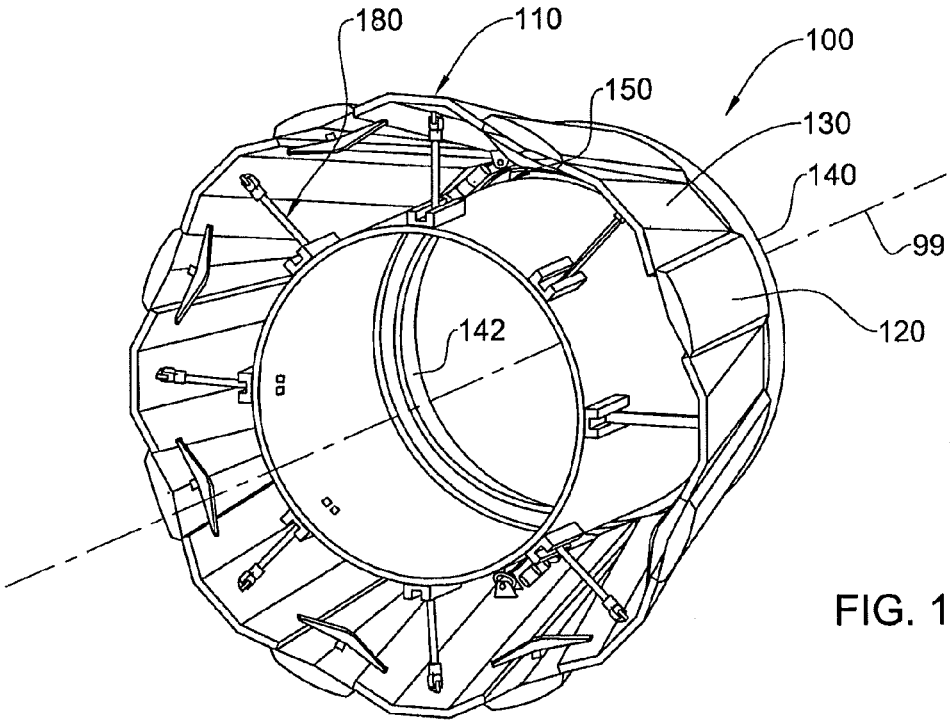
FIG. 1 shows, in rear perspective view, an apparatus according to the first embodiment of the invention, in deployed configuration.
Figure 2:
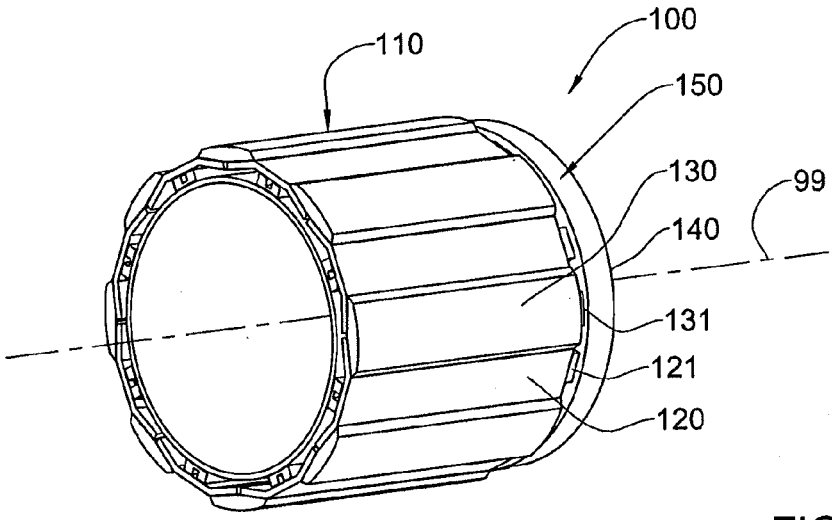
FIG. 2 shows, in rear perspective view, the embodiment of FIG. 1, in non-deployed configuration.

Referring to FIGS. 1 and 2, an apparatus for controlling a vehicle 10 according to a first embodiment of the invention is generally designated with reference numeral 100 and comprises a flare assembly 110, also interchangeably referred to as a skirt assembly, and actuation mechanism 150.

Figure 3A:
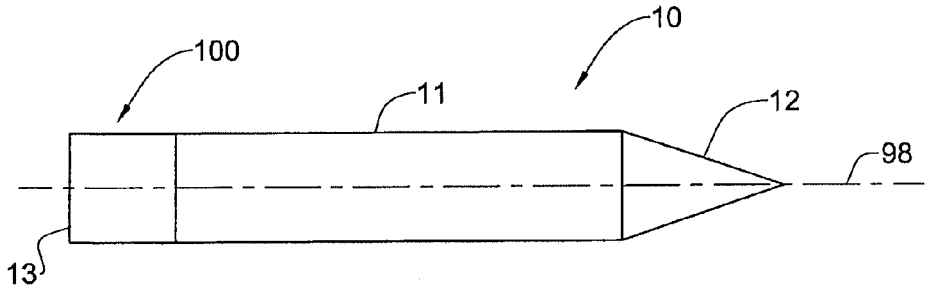
FIGS. 3(*a*) and 3(*b*) show, in side view, a vehicle comprising the embodiment of FIG. 1 in non-deployed configuration and deployed configuration, respectively.
Figure 3B:
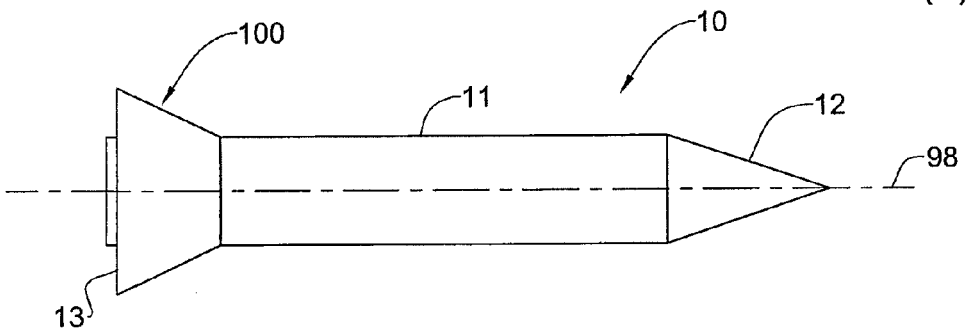

Referring also to FIGS. 3(*a*) and 3(*b*), the vehicle 10, by way of non-limiting example, may be a projectile, missile or the like, and comprises an elongate cylindrical body 11, having a pointed fore end 12, and a blunt aft end 13, which may comprise a powerplant, for example one or more rocket engines. However, the apparatus 10 is also applicable to any other suitable type of vehicle in flight, whether manned or unmanned, and/or whether powered or unpowered, and/or whether in motion in air, water or any other fluid medium, mutatis mutandis, including, for example, winged vehicles, underwater craft, and so on.

The flare assembly 110 is manipulable at least for being deployed from a non-deployed configuration (also referred to as a stowed configuration) to a deployed configuration. In the non-deployed configuration, the flare assembly may be generally aligned with the air stream (or alternatively may be projecting into the air stream at a minimum flare angle), in order to minimize drag, while in the deployed configuration, the flare assembly projects into the air stream (at a larger flare angle, up to a maximum flare angle) in such a way as to move the center of lift in an aft direction. The manipulable flare assembly 110 is hingedly mounted to load bearing structure 140, said structure 140 being configured for mounting to the vehicle 10, in particular near to or at the aft end 13 thereof.

In operation, the apparatus 100 provides centre of lift control to the vehicle 10, and transmits a moment thereto via structure 140, which includes an annular ring-like load bearing member 142 that is adapted for being attached to the vehicle 10 in a manner such as to transmit loads and moments therebetween. The apparatus 100 defines a longitudinal axis 99 passing through the geometric center of the load bearing member 142, and which in general is aligned with the longitudinal axis 98 of the vehicle when mounted thereto.

Figure 4:
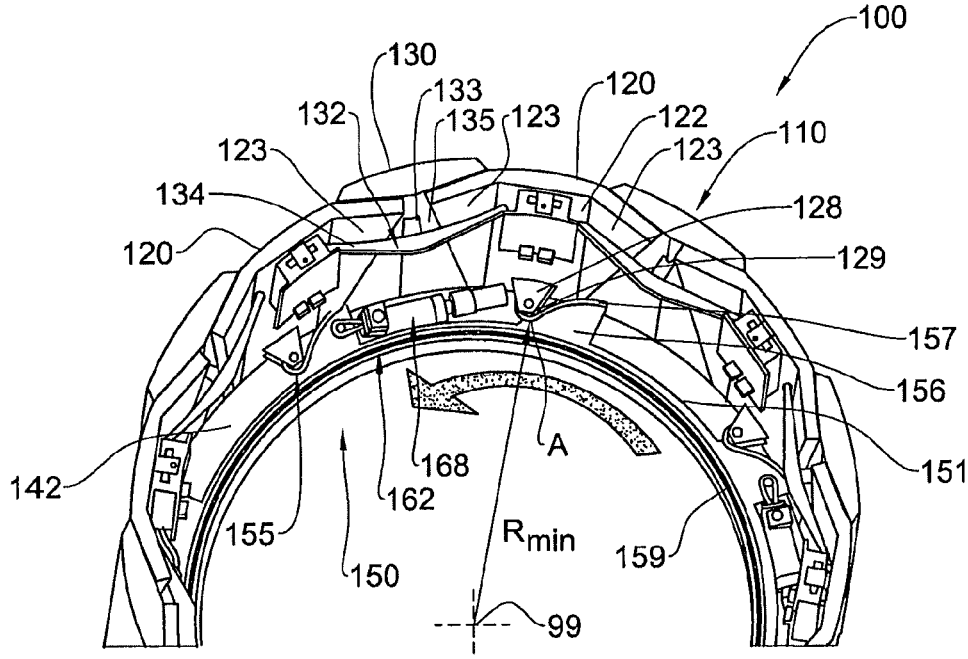
FIG. 4 shows, in rear perspective partial view, the embodiment of FIG. 1, in non-deployed configuration.
Figure 5:
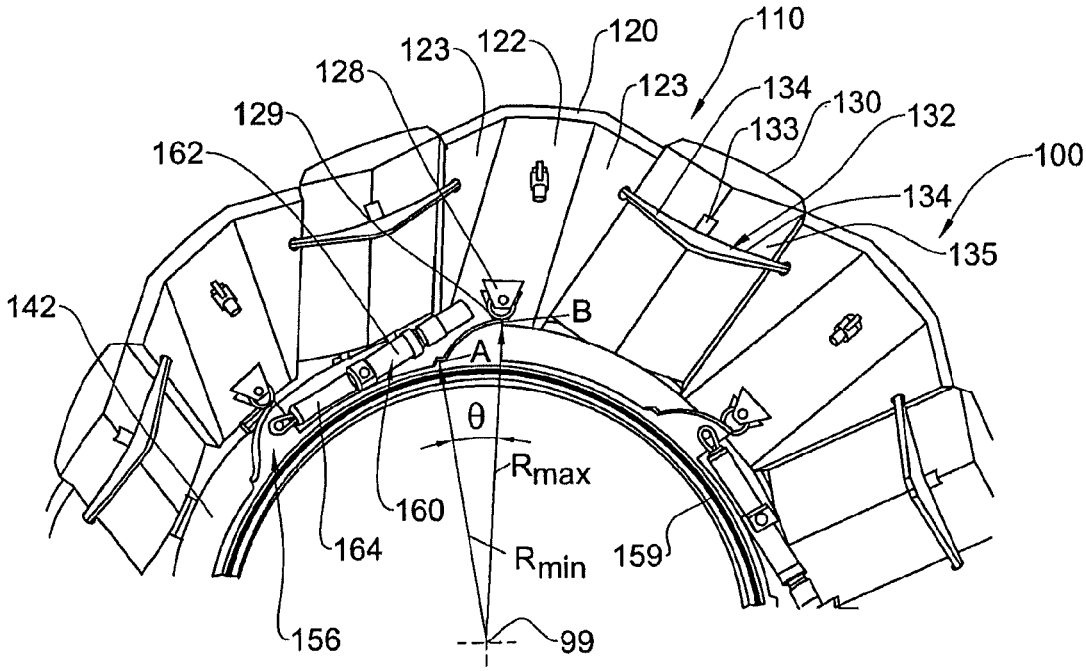
FIG. 5 shows, in rear perspective partial view, the embodiment of FIG. 1, in deployed configuration.
Figure 6:
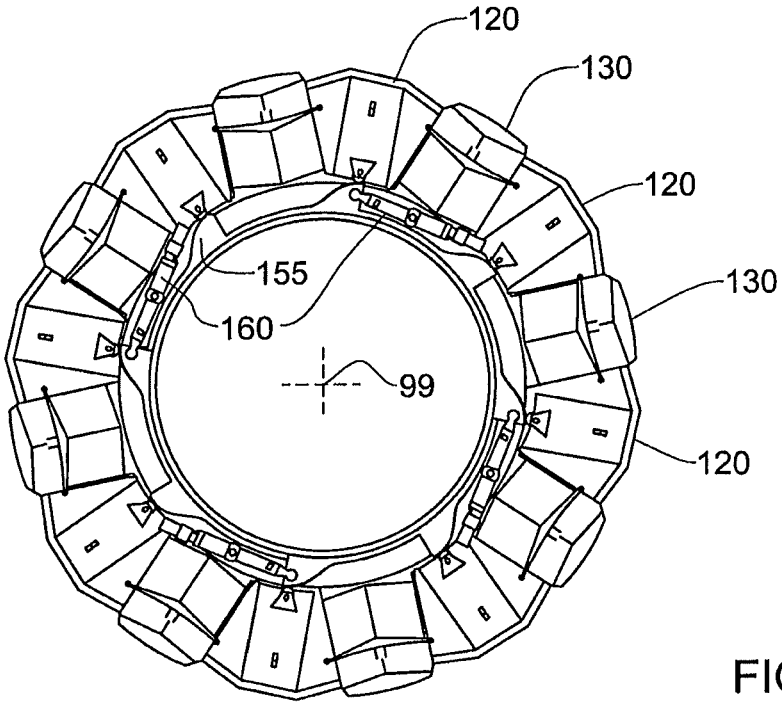
FIG. 6 shows, in rear view, the embodiment of FIG. 1, in deployed configuration.

Referring also to FIGS. 4, 5 and 6, the flare assembly 110 comprises a plurality of primary, active petals 120, and a plurality of secondary, passive petals 130. In the illustrated embodiment there are illustrated eight active petals and eight passive petals, though in alternative embodiments any suitable number of active and passive petals may be used; in yet other alternative embodiments the passive petals may be omitted altogether; in yet other embodiments the passive petals may be replaced with struts, mutatis mutandis, and interconnected by means of any suitable covering, for example a fabric, material, foil, accordion-like structure, or the like, having a relatively compact non-deployed configuration and capable of providing a generally frusto-conical form in the deployed configuration; in yet other embodiments the flare assembly may comprise a single active petal.

The active petals 120 and the passive petals 130 are each hingedly mounted at a fore end thereof to the load bearing member 142 via hinges 121, 131, respectively, and are circumferentially arranged on load bearing member 142 in an alternating manner, such that each passive petal 130 is adjacent two active members 120, one at each lateral side thereof, and similarly each active petal 120 is adjacent two passive members 130, one at each lateral side thereof.

In the illustrated embodiment the passive members 130 are generally rectangular in plan form, while the active petals 120 are generally trapezoidal in plan form, though in alternative embodiments the opposite may be the case, and in yet other alternative embodiments other suitable combinations for the forms of the active and passive petals may be provided. In this embodiment, and as best seen in FIGS. 4 and 5, the active petals 120 may be faceted, and comprise a central, substantially rectangular elongate portion 122, and a generally triangular plate portion 123 at each lateral side thereof, wherein the latter are inclined at an angle to the central portion 122 such as to abut the underside of the respective adjacent passive petals 130, at least in the non-deployed configuration. Furthermore, each passive petal 130 comprises a generally T-shaped guide member 132, having a stem 133 radially extending inwardly from the inner-facing side of the petal 130, and two arms 134 laterally projecting from the end of the stem 133. Each arm 134 defines a generally radial gap 135 into which the thickness of the adjacent triangular plate portion 123 of the adjacent active member 120 is received and which restricts relative movement between adjacent passive petals 130 and active petals 120 to a lateral sliding therebetween, i.e., in a generally circumferential manner.

The actuating mechanism 150 comprises a rotational member 155 that is operably associated with the flare assembly 110, and the actuating mechanism 150 is configured for manipulating the flare assembly 110 responsive to selective rotation of the rotational member 155 about axis 99. The rotational member 155 is in the form of an annular flange mounted for rotation with respect to the structure 140, in particular the load bearing member 142. In alternative embodiments, the rotational member may be configured for being mounted for rotation with respect to the vehicle 10, for example, rather than to the load bearing structure, and is thus not directly coupled mechanically with respect to the load bearing member 142.

Thus, in the illustrated embodiment, the actuating mechanism 150 comprises a bearing element 159 for facilitating rotational movement between the rotational member 155 and the load bearing member 142, about axis 99. The actuating mechanism also comprises, for each active petal 120, a roller 129 mounted for rotation to the respective active petal 120. In particular, the roller 129 has an axis of rotation generally parallel to or slightly inclined with respect to the axis 99, and is mounted at the end of a support strut 128 that radially projects inwardly from the inner facing side of the respective active petal 120, proximate to the hinge 131. In alternative embodiments some or only one of the active petals 120 comprises a said roller.

The rotational member 155 carries a plurality of cams, also referred to herein as guides 156, circumferentially arranged on the convex cylindrical side 151 thereof, the number and positions of the guides 156 corresponding to the number and positions of the rollers 129, i.e., there are eight guides 156 in the illustrated embodiment. Each guide 156 has an exterior surface 157 having a profile that varies smoothly from a minimum radius $R_{min}$ at position A, to a maximum radius $R_{max}$ at position B, with respect to the axis 99, providing a total radial displacement of ΔR. Each roller 129 is in radial registry with a respective guide 156, and cooperates with the respective guide 156 in operation of the device 100, such that in the non-deployed configuration, each the roller 129 is effectively parked in a position A, and as rotational member is rotated about axis 99 by an angle θ, the roller 129 rolls over the respective exterior surface 157 in a direction having a circumferential (lateral) component and a radial component, until in the fully deployed configuration the roller 129 is at position B, thereby causing the respective active petal 120 to swing radially outwardly about its respective hinge 131, providing a maximum flare angle α. At the same time, by means of the guide members 132, the passive petals 130 are also caused to swing radially outwardly about their respective hinges 131, and the flare assembly is thereby manipulated from a generally cylindrical form in the non-deployed configuration to adopt a generally frusto-conical form in the deployed configuration.

In alternative embodiments, at least some or all of the rollers may be mounted for rotation to the rotational member 155, while the corresponding guides may be mounted one to each respective active petal 120 so that as the rotational member is rotated bout the axis 99, the rollers cooperate with the guides in a similar manner to that described above, mutatis mutandis, to thereby open the active petals 120 and thereby, the passive petals 130 as well.

In the illustrated embodiment, motive force for the relative rotation between the rotational member 155 and the load bearing member 142 is provided by a suitable motion inducing mechanism (also referred to herein as a suitable motion inducing arrangement or a drive arrangement) wherein operation thereof is associated with a plane that intersects the axis 99 in a substantially orthogonal manner. The motion inducing mechanism in this embodiment is in the form of a plurality of pistons 160 arranged generally circumferentially with respect to axis 99 on a plane that intersects the axis 99 substantially orthogonally. In the illustrated embodiment, there are four pistons 160 uniformly arranged with respect to and coupled to alternate said guides 156. Each piston 160 comprises a base member 162 hingedly mounted to the load bearing member 142, and a driving member 164 reciprocable with respect to the respective base member 162 and hingedly mounted to the respective guide 156. Thus the four pistons 160 are operatively coupled to four guides 156 uniformly distributed among the eight guides 156. Thus, in operation of the device 100, as the driving member 164 is outwardly displaced with respect to the base member 162 in a generally tangential/circumferential direction with respect to the rotational member 155, this is rotated about axis 99 with respect to the load bearing member 142 thereby causing the rollers 129 to be rolled over the respective exterior surfaces in radial and circumferential directions and effectively moved to position B, thereby deploying the flare assembly 110.

In alternative embodiments the number and positions of the pistons 160 may generally correspond to the number and positions of the guides 156, in yet alternative embodiments there may be only one, two or any number of pistons mounted in the device such that during operation thereof the one or more pistons provide a rotational motive force for rotating the rotational member with respect to a static load bearing member, or for rotating the load bearing member with respect to the rotational member, which at least in some such alternative embodiments may be nevertheless static and wherein the load bearing member is mounted for rotation with respect to the vehicle 10.

In the illustrated embodiment, pistons 160 are pyrotechnic pistons, and in operation of the device 100 a pyrotechnic charge is ignited to push the driving member 164 away from the base member 162 for each piston 160. In alternative embodiments, any other suitable motion inducing mechanism may be provided, instead of or in addition to the pistons, for generating the required motive force for rotating one or the other of the rotational member 155 and the bearing member 142 to provide relative rotational movement therebetween about axis 99. For example, pistons actuated by hydraulic, pneumatic, electrical or other actuation means may be employed for generating the motive force. By way of further example, one or more of the rotational member 155 and the load bearing member 142 may comprise gear teeth or a frictional surface, for example, which cooperates with a gear or frictional wheel, respectively, of a motor so as to provide the desired rotational movement when the motor is turned, and the motor itself may be electrically powered, for example. In yet other alternative embodiments, the motion inducing mechanism may comprise one or more pre-stressed springs and a detent or the like that initially locks the apparatus in the non-deployed configuration. When the detent or the like is selectively released, the stored potential energy may be used as the motive force for the actuation mechanism 150.

In the illustrated embodiment, and indeed in alternative embodiments as well, mutatis mutandis, redundancy may be built into the actuation mechanism 150, so that in case of failure of one or more pistons 160, the remaining one or more pistons 160 provide enough motive force to rotate the rotational member 155 through angle θ and thus deploy the flare assembly 110 to the deployed configuration.

Figure 7:
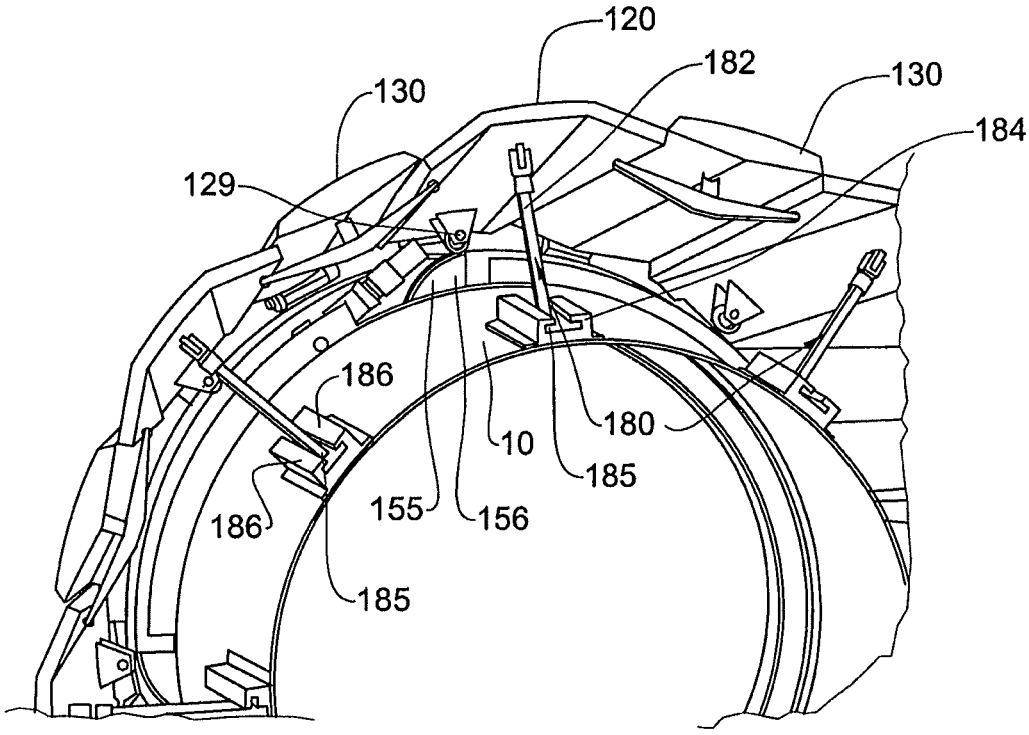
FIG. 7 shows, in rear perspective partial view, the embodiment of FIG. 1, in deployed configuration.

In this embodiment, and referring in particular to FIGS. 1 and 7, the apparatus 100 further comprises a locking mechanism 180 for locking the flare assembly 110 in the deployed configuration. The locking mechanism 180 comprises a plurality of struts 182, each strut 182 hingedly mounted at one end thereof to the inner facing side of the respective active petal 120 at a position aft of the respective roller 129. The other end 185 of each strut 182 is configured for sliding in a generally axial manner within a guide box 184. Each guide box 184 is configured for being mounted to the aft end of the vehicle 10, in radial registry with the respective active petal 120, and comprises a pair of transversely spaced, generally axial rails 186, and a transverse pin or roller arrangement (not shown) at the strut end 185 is constrained for slinging along rails 186 during operation of the device 100, such that in the non-deployed configuration at least a part of the strut 182 is accommodated in the generally longitudinal spacing between the respective pair of rails 186 and the pin or roller arrangement is at the aft end of guide box 184, while as the flare assembly is being deployed, the pin or roller arrangement translates in a forward direction to a fore position, where a suitable lock arrangement (not shown) locks the pin or roller arrangement at the position corresponding to the fully deployed configuration. The lock arrangement may comprise, for example, a mechanical latch, detent, wedge, and so on, for example, that prevents the pin or roller arrangement to translate back in an aft direction after it has reached the aforesaid fore position thereof.

In variations of this embodiment, the locking mechanism may be omitted, for example where the pistons or other motive arrangement for providing relative movement between the rotational member 155 and the load bearing member 142 is configured for providing controlled relative movement and for maintaining the relative angular disposition therebetween when the motive force ceases to be applied.

Figure 8:
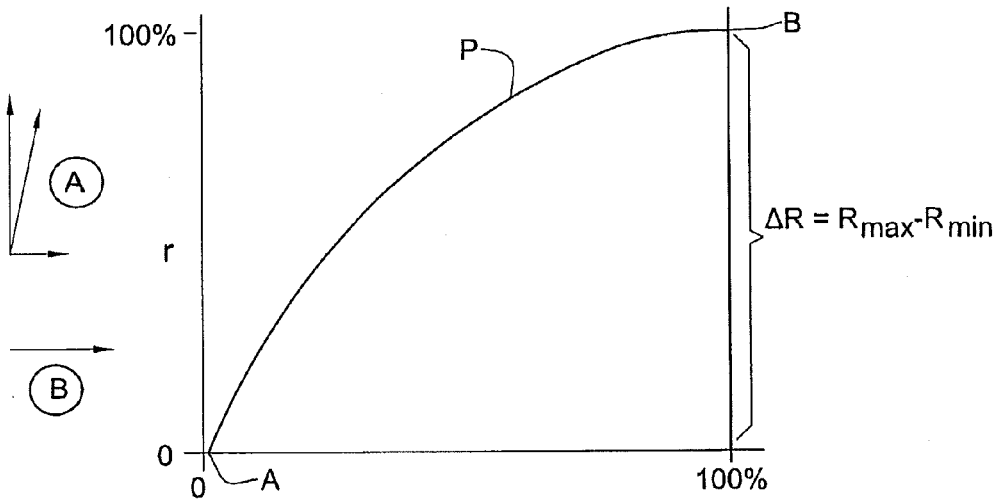
FIG. 8 illustrates an example profile for a guide of the embodiment of FIG. 1.

The guides 156 are substantially identical to one another, and the precise profile P of the exterior surface 157 of each guide 156 between positions A and B may be generated according to any desired criteria. For example, the profile P, which may be defined on a plane substantially orthogonal to the axis 99, may be chosen such as to provide a match between the working pressure required of the pistons 160 for operation thereof, and the aerodynamic forces applied on the flare assembly 110 (or, in alternative embodiments, on the hydrodynamic or other fluid forces applied on the flare assembly, mutatis mutandis, depending on the specific fluid medium in which the vehicle comprising the apparatus of the invention is in motion) during the deployment operation, and the inertia of the active and passive petals as they are opened to the deployed configuration during the deployment operation. These various forces are transmitted to the pistons via the exterior surface 157 of the respective guides 156, and essentially provide a reaction or opposing force resisting the action of the pistons in opening and thus deploying the flare assembly 110. The profile P may be chosen, for example, such as to provide the opening force component in a radial direction which exceeds the reactive forces during the full opening stroke of the respective piston, in which the rollers 129 are moved from position A to position B. For example, and referring to FIG. 8, at the start of the deployment operation, the aerodynamic and inertial forces acting on the flare assembly 110 are low, and thus the portion of the profile P proximate to position A may be relatively steep, providing a relative large radial force component, and allowing the petals to open relatively quickly with respect to a particular rate of change of angular disposition between the rotational member 155 and the load bearing member 142. The more the petals are opened, the greater the aerodynamic and inertial forces acting on the flare assembly 110, and thus the rate of radial displacement of the petals may be reduced correspondingly so as to maintain the reactive forces on the flare assembly 110 below the force generated by the operating pressure of the piston. Towards the end of the deployment operation, the aerodynamic forces are greatest, and thus the rate of radial displacement of the petals may be diminished to zero at position B. For example, the operating pressure and thus the force generated by the piston during the opening stroke may be substantially constant during operation thereof, and thus the profile may be chosen such that reactive forces are generated during deployment are always beneath this constant value. Alternatively, the operating pressure and thus the force generated by the piston during the opening stroke may vary in a particular manner as a function of the movement of the piston during the opening stroke, and thus the profile of the exterior surface 157 may be chosen such that reactive forces are generated during deployment are always beneath the corresponding value of the opening force generated by the pistons. In any case, and by way of example, the profile P may be calculated using the following formula:—

$$r=a*\sin(\pi*x/2L)+d[1-\exp(-x/b)]$$ wherein:

r is the radial dimensional component of the profile P at a particular tangential or circumferential displacement from position A;

L is the length of the petals in a generally axial direction;

a, b and d are suitable scalar coefficients.

In alternative embodiments, any other suitable profile for the exterior surfaces 157 may be chosen—for example, a linear profile, a curved profile having a relatively steep gradient at position A and relatively shallow gradient at position B, or a curved profile having a relatively shallow gradient at position A and relatively steep gradient at position B.

In alternative embodiments, the apparatus is configured for enabling the flare assembly to be manipulable for being deployed from a non-deployed configuration to a deployed configuration, as disclosed above, mutatis mutandis, for example, and to be further manipulable also for being retracted to the non-deployed configuration from the deployed configuration. For example, the motion inducing mechanism may be configured for providing a motive force also in the reverse direction to the motive force required for deploying the flare assembly to the deployed configuration. For example, in such alternative embodiments the motion inducing mechanism may comprise a second set of pistons that are mounted in the apparatus for effecting a counter rotation of the rotational member 155 with respect to the load bearing member 142, i.e., in an opposite direction to the rotation direction for deploying the flare assembly. Alternatively, in some such alternative embodiments, the same motion inducing mechanism that is used for providing the motive force to deploy the flare assembly may be configured for use in a reverse mode for providing the aforesaid required counter rotation. Such alternative embodiments may find particular use in applications wherein the vehicle on which the apparatus according to the invention is mounted in which the static margin and/or the velocity and/or the drag thereof needs to be reversibly changed between two particular settings, a first setting corresponding to full deployment configuration of the apparatus, and a second setting corresponding to the non-deployed configuration of the apparatus.

In alternative embodiments, the apparatus is configured for enabling the flare assembly to be manipulable for being selectively set at any desired flare setting, comprising any desired intermediate configuration ranging between the fully deployed configuration and the non-deployed configuration, and thus having an intermediate flare angle less than the maximum flare angle $\alpha$. For example, the motion inducing mechanism may be configured for providing a motive force for selectively controllably partially or fully deploying the flare assembly to the deployed configuration, i.e., to provide any desired flare angle $\alpha$ (also referred to interchangeably herein as the deployment angle $\alpha$) between the minimum deployment angle, corresponding to the non-deployed configuration, to the maximum deployed angle, corresponding to the fully deployed configuration. Optionally, the motion inducing mechanism may be configured for providing any such desired partial deployment, starting from a more deployed configuration having a larger deployment angle, such as to reduce the deployment angle, or starting from a less deployed configuration, having a smaller deployment angle. For example, in such alternative embodiments the motion inducing mechanism may comprise a single set of pistons which are controllably actuable in one direction, or optionally in two opposed directions, in a selectively controllable manner such as to turn the rotational member 155 with respect to the load bearing member 142, for a desired angular displacement corresponding to the desired deployment angle for the flare assembly. Such alternative embodiments may find particular use in applications wherein the vehicle on which the apparatus according to the invention is mounted may be controlled in a manner in which the static margin and/or the velocity and/or the drag thereof needs to be controllably varied as desired between two particular limits, a first limit corresponding to full deployment configuration of the apparatus, and a second limit corresponding to the non-deployed configuration of the apparatus. For example, such alternative embodiments allow for the static margin to be varied, which may be desirable in applications of the invention in which the static margin would otherwise vary significantly due to loss of propellant during powered flight, for example, or in the case of a multistage vehicle, every time another stage is jettisoned. In some such alternative embodiments, the deployment angle may be varied in real time in response to changes in conditions, and optionally in either direction, by using one or more pairs of push-pull actuators.

In the method claims that follow, alphanumeric characters and Roman numerals used to designate claim steps are provided for convenience only and do not imply any particular order of performing the steps.

It should be noted that the word "comprising" as used throughout the appended claims is to be interpreted to mean "including but not limited to".

While there has been shown and disclosed example embodiments in accordance with the invention, it will be appreciated that many changes may be made therein without departing from the spirit of the invention.

The invention claimed is:

1. Apparatus for controlling a vehicle in motion through a fluid medium, comprising:

a manipulable flare assembly mounted to a load bearing structure, said load bearing structure being configured for mounting to the vehicle; and an actuating mechanism including a rotational member operably associated with the flare assembly, said actuating mechanism being configured for selectively providing relative rotation between said rotational member and said load bearing structure about a longitudinal axis passing through a geometric center of said load bearing structure, wherein said actuating mechanism is configured for manipulating said flare assembly, at least from a non-deployed configuration to a deployed configuration to provide at least a frusto-conical form, responsive to selective relative rotation between said rotational member and said load bearing structure about said longitudinal axis.

2. Apparatus according to claim 1, wherein said load bearing structure is configured for being statically mounted to the vehicle, and said rotational member is rotatably mounted to said load bearing structure.

3. Apparatus according to claim 1, wherein said flare assembly is manipulable at least from said non-deployed configuration to said deployed configuration responsive to a selective relative rotation between said rotational member and said load bearing structure.

4. Apparatus according to claim 1, wherein the vehicle is adapted for motion through air, and said flare assembly comprises at least one aerodynamic load-bearing element hingedly mounted to said load bearing structure, wherein said flare assembly is manipulable to enable said at least one aerodynamic load-bearing element to be deflected in at least an outwardly generally radial direction with respect to a longitudinal axis of said apparatus to provide a desired flare angle for said flare assembly, including at least a flare angle corresponding to said deployed configuration.

5. Apparatus according to claim 1, wherein said flare assembly comprises at least one load-bearing element hingedly mounted to said load bearing structure and configured for generating fluid-dynamic loads when deflected, wherein said flare assembly is manipulable to enable said at least one aerodynamic load-bearing element to be deflected in at least an outwardly generally radial direction with respect to a longitudinal axis of said apparatus to provide a desired flare angle for said flare assembly, including at least a flare angle corresponding to said deployed configuration.

6. Apparatus according to claim 5, wherein said flare assembly comprises a plurality of said load bearing elements in the form of active petals and passive petals, each said petal being hingedly mounted at one end thereof to said load bearing structure in circumferential arrangement with respect to said longitudinal axis of said apparatus, wherein said flare assembly is manipulable to enable each said petal to be deflected in at least an outwardly generally radial direction to provide a desired flare angle for said flare assembly, including at least said flare angle corresponding to said deployed configuration.

7. Apparatus according to claim 6, wherein each said passive petal is intercalated between, and coupled for movement with, one said active petal at each lateral side thereof.

8. Apparatus according to claim 7, wherein each said passive petal comprises a coupling element configured for enabling a said active petal on either lateral side thereof to be slidingly engaged with freedom of movement in a general transverse direction with respect thereto.

9. Apparatus according to claim 6, wherein said rotational member is operably associated with the flare assembly via a guide and roller arrangement, comprising at least one set of a roller and a guide.

10. Apparatus according to claim 9, wherein said at least one set of a roller and a guide is associated with a respective said active petal, and wherein in operation of said actuation mechanism said roller cooperates with a respective guide in a manner to at least deploy the respective said active petal.

11. Apparatus according to claim 10, wherein for at least one said set of a roller and a guide, the respective roller is mounted for rotation to the respective said active petal, and wherein the respective guide is provided in said rotational member.

12. Apparatus according to claim 10, wherein each respective said guide comprises an external surface which cooperates with said roller during operation of said actuation mechanism, said exterior surface having a profile configured for displacing the roller in an outwardly radial direction with respect to said axis with said relative rotation between said rotational member and said load bearing structure.

13. Apparatus according to claim 12, wherein said profile is configured for providing a radial displacement for said flare assembly as a function of said rotation such as to maintain external reaction forces on said flare assembly, generated responsive to said radial displacement, at a magnitude less than said drive force.

14. Apparatus according to claim 13, wherein said profile provides a first rate of said radial displacement with respect to an angular displacement associated with said rotation at low values of said radial displacement, progressively changing to a second rate of said radial displacement with respect to said angular displacement at higher values of said radial displacement, and approaching zero change in radial displacement at a maximum value of radial displacement, wherein said first rate is greater than said second rate.

15. Apparatus according to claim 1, wherein said rotational member is operably associated with the flare assembly via a guide and roller arrangement, comprising at least one set of a roller and a guide.

16. Apparatus according to claim 1, wherein said actuation mechanism comprises a motion-inducing mechanism configured for selectively providing a drive force for driving said selective relative rotation between said rotational member and said load bearing structure.

17. Apparatus according to claim 16, wherein said motion inducing mechanism comprises at least one piston configured for extending in a generally non-radial direction, and coupled to said rotational member and said load bearing structure to provide said relative rotation therebetween during operation of said actuation mechanism.

18. Apparatus according to claim 17, wherein at least one said piston is selectively actuatable by means of a pyrotechnic charge.

19. Vehicle configured for moving through a fluid medium and comprising an apparatus according to claim 1.

20. Vehicle according to claim 19, wherein said vehicle is an air vehicle, configured for atmospheric flight.

21. A method for controlling a vehicle in motion through a fluid medium, comprising:

providing a manipulable flare assembly mounted to the vehicle in a load bearing manner with respect thereto;

providing an actuating mechanism comprising a rotational member operably associated with the flare assembly, said actuating mechanism being configured for selectively providing relative rotation between said rotational member and said load bearing structure about a longitudinal axis of the vehicle passing through a geometric center of said load bearing structure, wherein said actuating mechanism is configured for an actuating force for manipulating said flare assembly, at least from a non-deployed configuration to a deployed configuration to provide at least a frusto-conical form, responsive to selective relative rotation between said rotational member and said load bearing structure about said longitudinal axis; and selectively providing said actuating force for manipulating said flare assembly to thereby control the vehicle, wherein at least a component of said actuating force is directed along a plane substantially normal to said longitudinal axis of the vehicle.

22. Method according to claim 21, wherein a cam arrangement is provided for transferring said actuating force to said flare assembly for manipulation thereof, wherein said cam arrangement comprises at least one cam, said cam being configured for providing a radial displacement for said flare assembly as a function of said rotation via a cam profile such as to maintain external reaction forces on said flare assembly, generated responsive to said radial displacement, at a magnitude less than said drive force.

23. Method according to claim 22, wherein said cam profile provides a relatively high rate of said radial displacement with respect to an angular displacement associated with said rotation at low values of said radial displacement, progressively changing to a relatively low rate of said radial displacement with respect to said angular displacement at higher values of said radial displacement, and approaching zero change in radial displacement at a maximum value of radial displacement.

24. A method for manipulating a flare assembly, the method comprising:

selectively providing a drive force coupled to said flare assembly via a cam arrangement having at least one cam, wherein the or each said cam comprises a cam profile defined on a plane substantially orthogonal to a longitudinal axis of the flare assembly and configured for providing a radial displacement for said flare assembly with respect to a longitudinal axis thereof responsive to said drive force being applied to said flare assembly via said cam arrangement, such as to maintain external reaction forces on said flare assembly, generated responsive to said radial displacement, at a magnitude less than said drive force, and manipulating at the flare assembly at least from a non-deployed configuration to a deployed configuration to provide at least a frusto-conical form.

25. Method according to claim 24, wherein said cam profile provides a first rate of said radial displacement at low values of said radial displacement, progressively changing to a second rate of said radial displacement at higher values of said radial displacement, and approaching zero change in radial displacement at a maximum value of radial displacement, wherein said first rate is greater than said second rate.

* * * * *